US006115562A

United States Patent [19]

Ogawa et al.

[11] Patent Number: 6,115,562

[45] Date of Patent: Sep. 5, 2000

[54] IMAGE FORMING DEVICE

[75] Inventors: Masashi Ogawa, Kasuga; Hisanobu Matsuzoe, Chikushino; Kouji Migita, Chikushi-gun; Yasunori Sagara, Kasuga; Kazuo Hakukawa; Shinichi Kizu, both of Fukuoka; Yusuke Shiibara, Kasuga; Yukinori Hara, Kasuya-gun, all of Japan

[73] Assignee: Matsushita Electric Industrial Co., Ltd., Osaka, Japan

[21] Appl. No.: 09/269,194

[22] PCT Filed: Sep. 29, 1997

[86] PCT No.: PCT/JP97/03463

§ 371 Date: Mar. 30, 1999

§ 102(e) Date: Mar. 30, 1999

[87] PCT Pub. No.: WO98/37460

PCT Pub. Date: Aug. 27, 1998

[30] Foreign Application Priority Data

Feb. 20, 1997 [JP] Japan ..... 9-035887
May 13, 1997 [JP] Japan ..... 9-121961

[51] Int. Cl.[7] ..... G03G 15/16

[52] U.S. Cl. ..... 399/66; 399/45; 399/162; 399/297

[58] Field of Search ..... 399/45, 66, 162, 399/163, 151, 155, 297; 400/708

[56] References Cited

U.S. PATENT DOCUMENTS

| | | | |
|---|---|---|---|
| 5,216,453 | 6/1993 | Itoh | 399/297 X |
| 5,609,426 | 3/1997 | Ito et al. | 400/708 X |
| 5,819,133 | 10/1998 | Matsuzoe et al. | 399/66 |
| 5,940,106 | 8/1999 | Walker | 399/45 X |
| 6,044,240 | 3/2000 | Sagara et al. | 399/297 X |

FOREIGN PATENT DOCUMENTS

| | | |
|---|---|---|
| 63-054267 | 3/1988 | Japan . |
| 4-69254 | 4/1992 | Japan . |
| 8-314291 | 11/1996 | Japan . |

*Primary Examiner*—Sophia S. Chen
*Attorney, Agent, or Firm*—McDermott, Will & Emery

[57] ABSTRACT

A toner image which is carried by a photosensitive endless belt is pressed against a printing paper by a transfer opposed roller provided inside the photosensitive belt to transfer the toner image onto the printing paper, and the image transferred onto the printing paper is fixed. The position of the transfer roller which is moved inside the photosensitive belt is detected by a detector. When the detected position agrees with a predetermined position, the moving direction is reversed by a control unit and the moving distance of the transfer roller is varied in accordance with the size of the image ad, further, the contamination of the backside of the printing paper is avoided.

10 Claims, 12 Drawing Sheets

IMAGE FORMING DEVICE

FIELD OF THE INVENTION

The present invention relates to an image forming device which transfers a toner image from a belt shaped toner image carrying member to a print sheet by means of a roller.

BACKGROUND OF THE INVENTION

In recent years such an image forming device of toner system as exemplified by a laser printer has been widely used to enable a clear image with excellent resolution to be produced.

Here, a prior art image forming device of quadrature transfer system will be first explained.

FIG. 9 is a diagrammatic sketch of a prior art image forming device of quadrature transfer system, FIG. 10 is a perspective view of the foregoing image forming device and FIG. 11 is a diagram to show the transfer state of an opposed transfer roller of the foregoing image forming device. In FIG. 9, FIG. 10 and FIG. 11, the reference symbol 1 is a photosensitive belt, the reference symbol 2 is a charging unit, the reference symbol 3 is an image developer, the reference symbol 3*a* is toner, the reference symbol 3*b* is an image development roller, the reference symbol 3*c* is a toner image, the reference symbol 4 is a photosensitive belt cleaner, the reference symbol 5 is a discharging unit, the reference symbol 6 is a light exposure unit, the reference symbol 7 is a print sheet, the reference symbol 8 is an opposed transfer roller, the reference symbols 9*a* to 9*c* are photosensitive rollers, the reference symbol 10 is a transfer plate and the reference symbol 11 is a print sheet transporting roller.

As shown in FIG. 9, a closed loop belt like shape photosensitive belt 1, the surface of which is coated with an organic photoconductive material, is supported by photosensitive rollers 9*a* to 9*c* and an opposed transfer roller 8 and also made movable rotationally in the direction of an arrow A. A photosensitive material cleaner 4, a discharging unit 5, a charging unit 2, a light exposure unit 6 and an image developer 3 are arranged in this order along the direction of a rotational movement of the photosensitive belt 1, and further toner 3*a* is contained inside of the image developer 3. In addition, a print sheet 7 is supported by a transfer plate 10 and transported in the direction C perpendicular to the rotational direction A of the photosensitive belt 1 by a print sheet transporting roller 11 as shown in FIG. 10.

An explanation will be made on how a prior art image forming device of quadrature transfer system as structured above operates. Upon receiving directions for an image forming operation from a controller of the image forming device such as a CPU and the like, a photosensitive roller driving means such as a motor and the like make the photosensitive rollers 9*a* to 9*c* rotate, thereby starting the rotation of the photosensitive belt 1 in the direction of the arrow A. First, the photosensitive belt 1 has the surface thereof charged by the charging unit 2 and then an electrostatic latent image is formed on the charged surface by laser light 6*a* irradiated from the light exposure unit 6 according to the content of an image to be formed.

When the area of the photosensitive belt 1 where the electrostatic latent image has been formed arrives at the position of the image developer 3, an image development roller 3*b* installed in the image developer 3 is rotated by an image development roller driving means such as a motor and the like and at the same time brought into contact with the photosensitive belt 1. Accordingly, while the photosensitive belt 1 is sandwiched and moved between the image development roller 3*b* and the photosensitive roller 9*b*, the electrostatic latent image is developed by the toner 3*a* attached to the surface of the image development roller 3*b* and a toner image 3*c* is formed on the photosensitive belt 1.

After the toner image 3*c* corresponding to a single sheet of the print sheet in size has been formed on the photosensitive belt 1 in the foregoing step of operation, the toner image 3*c* is transferred from the photosensitive belt 1 to the print sheet 7.

Before a transfer of the toner image 3*c* takes place, the rotation of the photosensitive rollers 9*a* to 9*c* is suspended with a resulting stop of the rotational movement of the photosensitive belt 1 when a tip p 1 (FIG. 9) of the toner image 3*c* formed on the photosensitive belt 1 arrives at almost the same position as an end p 2 of the image forming area of the print sheet 7.

Then, the print sheet transporting roller 11 is rotated by a print sheet transporting roller driving means such as a motor and the like and the print sheet 7 is transported on the transfer plate 10 in the direction C (print sheet transporting direction) perpendicular to the direction A of the rotational movement of the photosensitive belt 1 to a specified position. Upon completion of transporting of the print sheet 7, the opposed transfer roller 8 is moved horizontally along the surface of the print sheet 7 in the direction of an arrow B as shown in FIG. 10 and FIG. 11 from a transfer starting position p 3 to a transfer ending position p 4 (FIG. 11). While this horizontal travel of the opposed transfer roller 8 is taking place, the toner image 3*c* on the photosensitive belt 1 is transferred on the print sheet 7 through consecutive steps of having the photosensitive belt 1 pressed against the print sheet 7 by the opposed transfer roller 8.

When the transferring of the toner image 3*c* is finished, the print sheet transporting roller 11 starts to rotate again and the print sheet 7, on which an image is formed, is rolled out. When the rolling out of the print sheet 7 is finished, the photosensitive belt 1 starts to move again, the area, where the toner image 3*c* was transferred on the photosensitive belt 1, gets rid of the toner that remained on the photosensitive belt 1 by means of the photosensitive belt cleaner 4 and then the electric charge that remained on the photosensitive belt 1 is made to disappear by means of the discharging unit 5.

Accordingly, a given image such as lettering, graphics and the like is formed on the single sheet of the print sheet 7, and the same image forming process as above is repeated in succession as needed.

Next, an explanation will be made on a prior art image forming device of parallel transfer system.

FIG. 12 is a diagrammatic sketch of a prior art image forming device of parallel transfer system, FIG. 13 is a perspective view of the image forming device of FIG. 12 and FIG. 14 is a diagram to show the transfer state of an opposed transfer roller of the image forming device of FIG. 12. Here, an explanation will be made only on the part where the foregoing image forming device differs from the previously described image forming device of quadrature transfer system.

In FIG. 12 and FIG. 13, a photosensitive belt 1 is wound around photosensitive rollers 9*a*, 9*b* and 9*c* that are rotated by means of a motor and the like so as to make the photosensitive belt 1 movable in the direction indicated by an arrow A. The movement direction of this photosensitive belt 1 is the same as the feeding direction of a print sheet 7 that is supplied onto a transfer plate 10 by means of a print sheet transporting roller 11, and the print sheet 7 is supported by the transfer plate 10 and transported in the same direction as the photosensitive belt 1 is moved by means of the print sheet transporting roller 11 as shown in FIG. 13.

How a toner image 3*c* formed on the photosensitive belt 1 is transferred onto the print sheet 7 in the prior art image forming device is as described below.

The print sheet transporting roller 11 is rotated by a driving means such as a motor and the like, thereby transporting the print sheet 7 on the surface of the transfer plate 10 in the same direction as the moving direction of the photosensitive belt 1 to a specified position. Upon finishing the transporting of the print sheet 7, an opposed transfer roller 8 is moved horizontally on the surface of the print sheet 7 in the direction indicated by an arrow B in FIG. 14 from a transfer starting position p 3 to a transfer ending position p 4. While the horizontal travel of this opposed transfer roller 8 is taking place, the toner image 3*c* on the photosensitive belt 1 is transferred onto the print sheet 7 through consecutive steps of having the photosensitive belt 1 pressed against the print sheet 7 by the opposed transfer roller 8, thereby forming a printed image 3*d* on the print sheet 7 as shown in FIG. 13. Further, when the opposed transfer roller 8 has arrived at the transfer ending position p 4, the opposed transfer roller 8 starts to move in the reversed direction and returns to the transfer starting position p 3.

However, with the foregoing prior art image forming device, the opposed transfer roller 8 travels the maximum width between p 3 and p 4 even if a small sized print sheet is used, thereby causing the extra amount of toner left on the photosensitive belt 1 at the place, where no pressing on the print sheet takes place, to get shifted toward the transfer plate 10. Thereafter, when a large sized print sheet 7 is used, the toner shifted onto the transfer plate 10 is attached to the back side surface of the print sheet 7 to present a problem of form a smear (back smear). Further, regardless of the size of the image to be printed, the traveling distance of the opposed transfer roller 8 remains the same and so the time required for image transferring also remains the same, resulting in a problem of reduced efficiency.

DISCLOSURE OF THE INVENTION

The object of the present invention is to provide an image forming device that makes it possible to prevent back smear of print sheets and perform fast printing by changing transfer time according to the size of an image to be printed.

In order to attain this object, the present invention discloses an image forming device comprising an image carrying belt of a closed loop belt like shape, an opposed transfer roller arranged in position on the inner side of the foregoing image carrying belt to transfer a toner image carried on the image carrying belt onto a record medium by moving along the record medium, a detecting means for detecting the position of the foregoing opposed transfer roller, and a controlling means for reversing the moving direction of the foregoing opposed transfer roller when the position of the foregoing opposed transfer roller detected by the foregoing detecting means reaches a specified position, thus having the effect of allowing the distance of the opposed transfer roller's traveling to be changed in accordance with the circumstances.

BREIF DESCRIPTION OF THE DRAWINGS

FIG. 4(*a*) to FIG. 4(*e*) are the diagrams to show how an image forming device in a second exemplary embodiment of the present invention performs.

Figure 5:
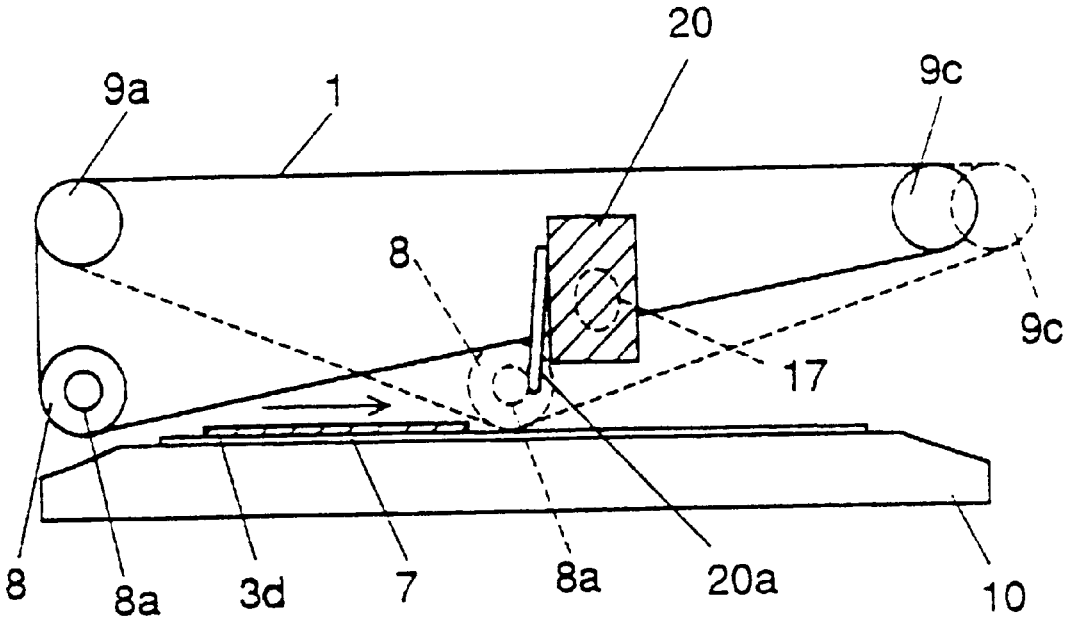

FIG. 5 is a cross-sectional view of an image forming device of parallel transfer system in a third exemplary embodiment of the present invention to show a state of movement of an opposed transfer roller when the amount of image data is small.

Figure 6:
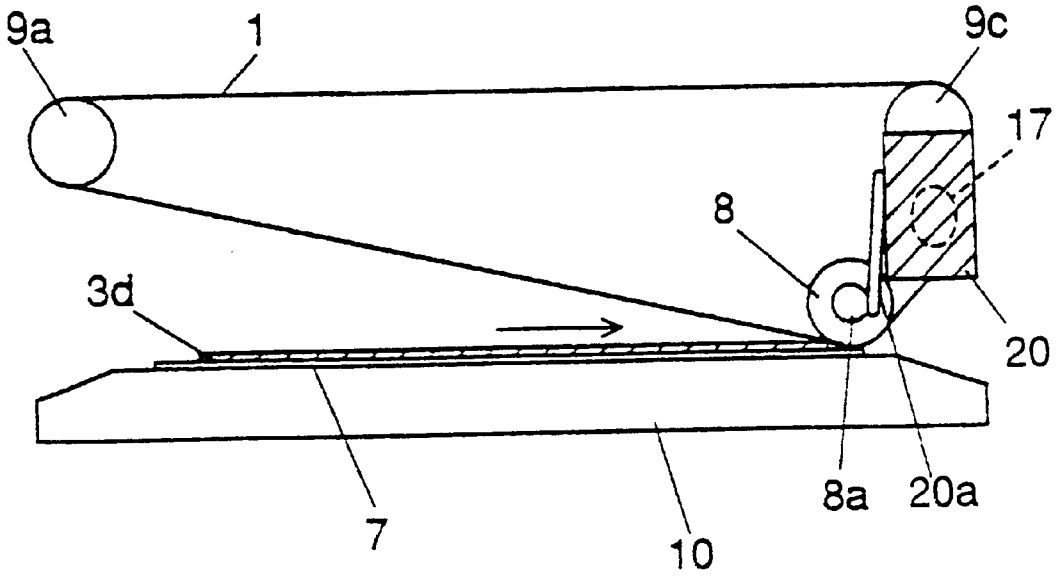

FIG. 6 is a cross-sectional view of the image forming device of FIG. 5 to show a state of movement of the opposed transfer roller when the amount of image data is large.

Figure 7:
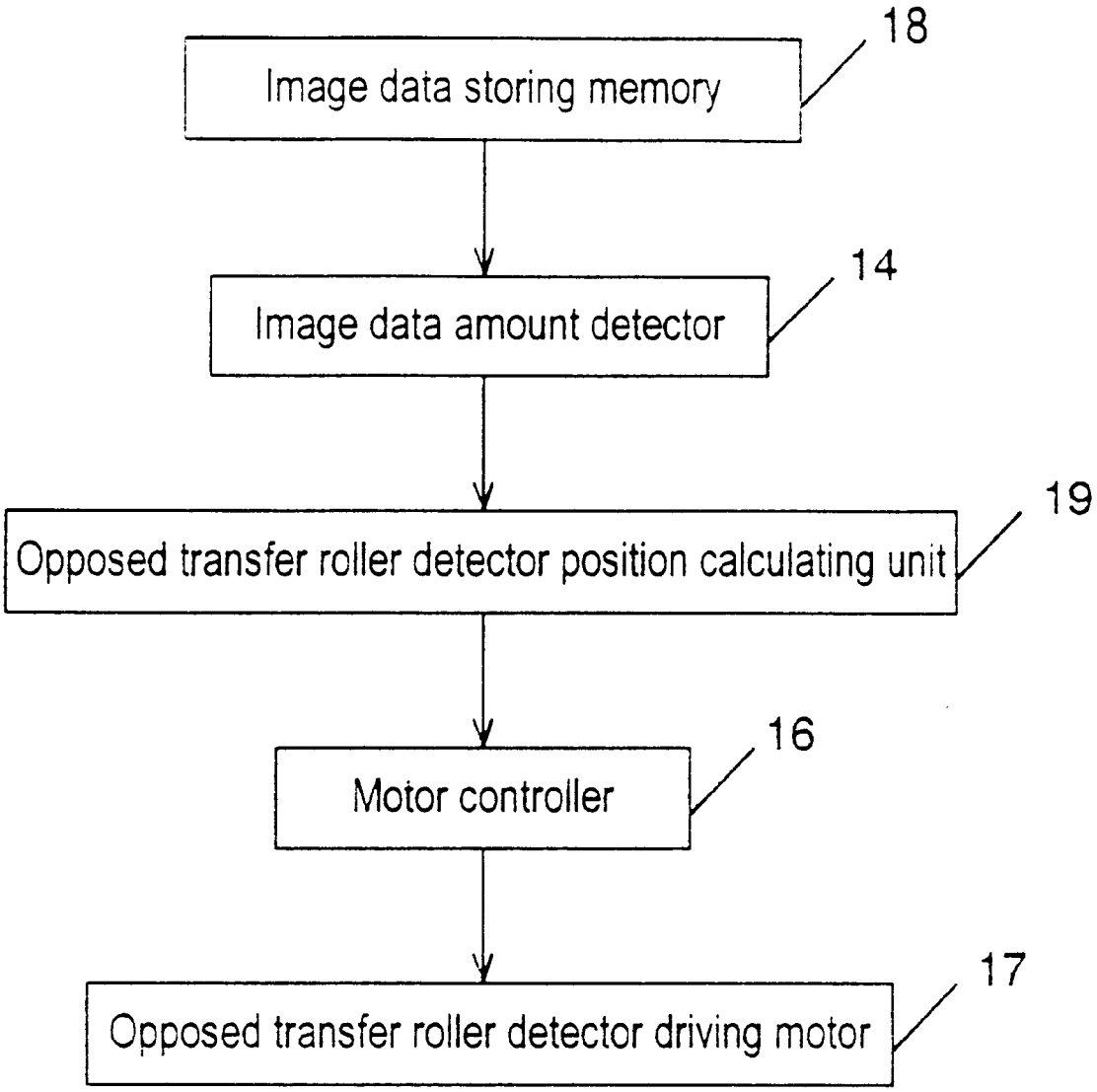
Figure 8A:
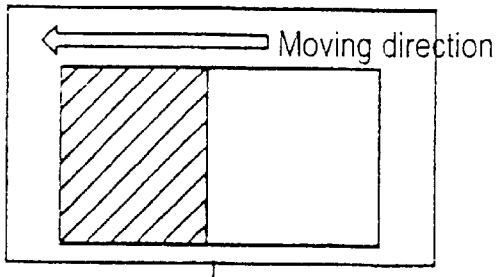
Figure 8B:
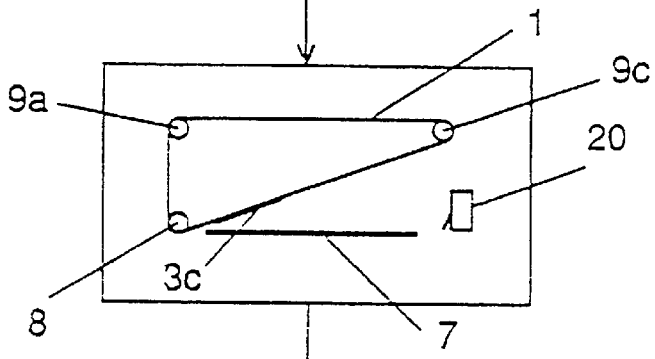
Figure 8C:
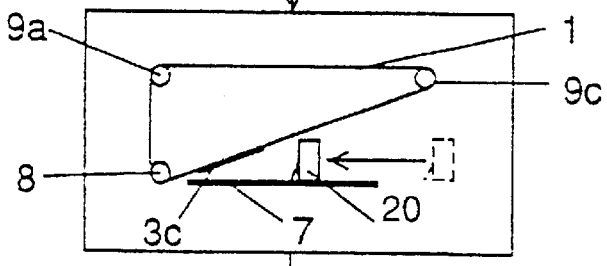
Figure 8D:
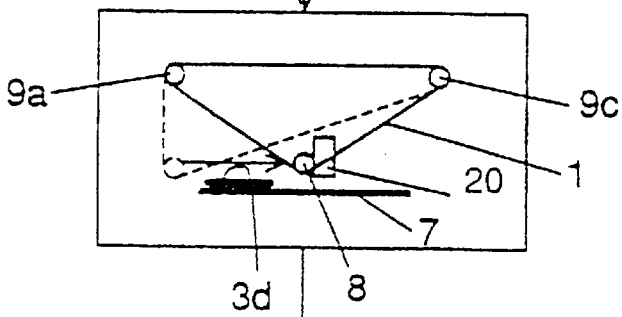
Figure 8E:
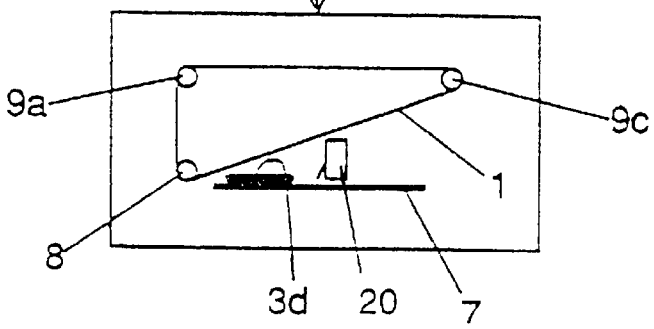

FIG. 7 is a control block diagram of the image forming device of parallel transfer system in the third exemplary embodiment of the present invention.

FIG. 8(*a*) to FIG. 8(*e*) show diagrams describing the performance of the image forming device of parallel transfer system in the third exemplary embodiment of the present invention when the stroke of the opposed transfer roller is changed according to the amount of image data.

Figure 9:
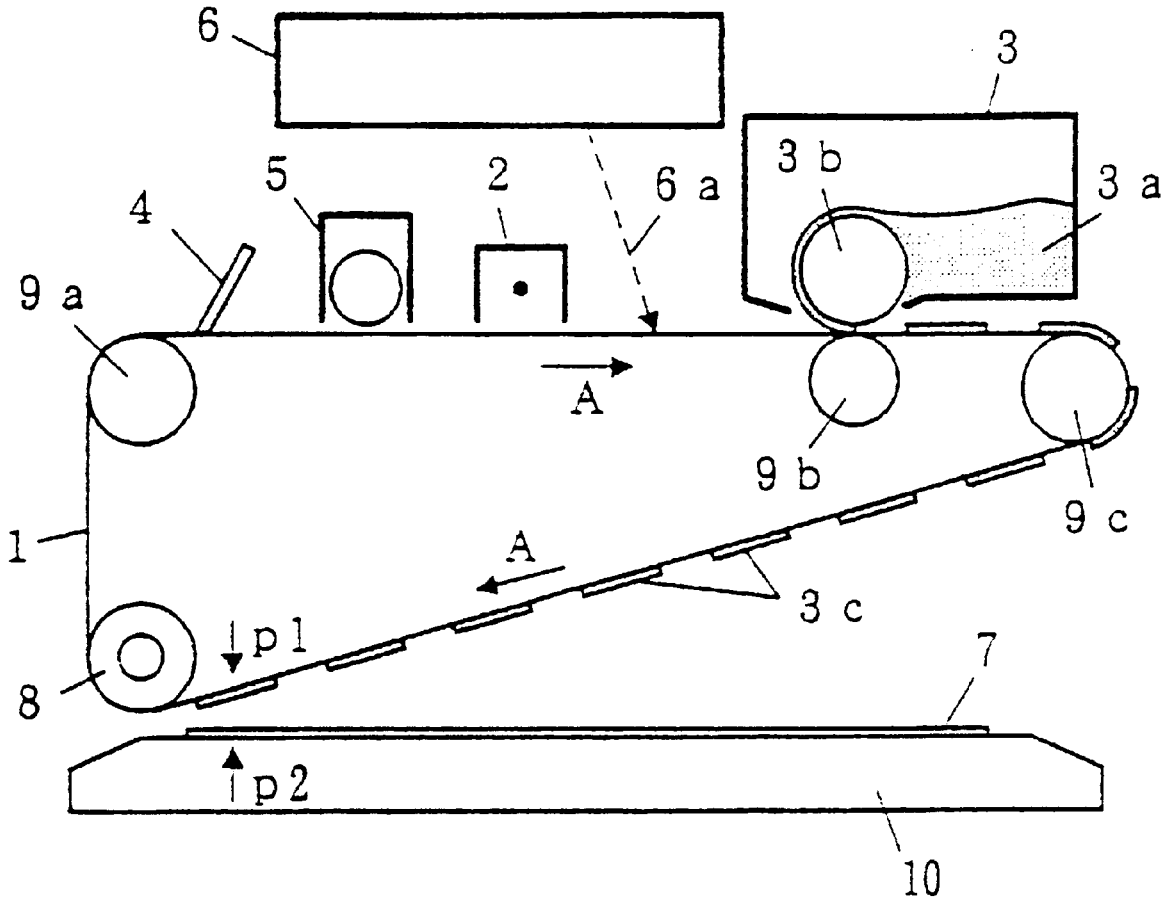
FIG. 9 PRIOR ART

FIG. 9 is a diagrammatic sketch of a prior art image forming device of quadrature transfer system.

Figure 10:
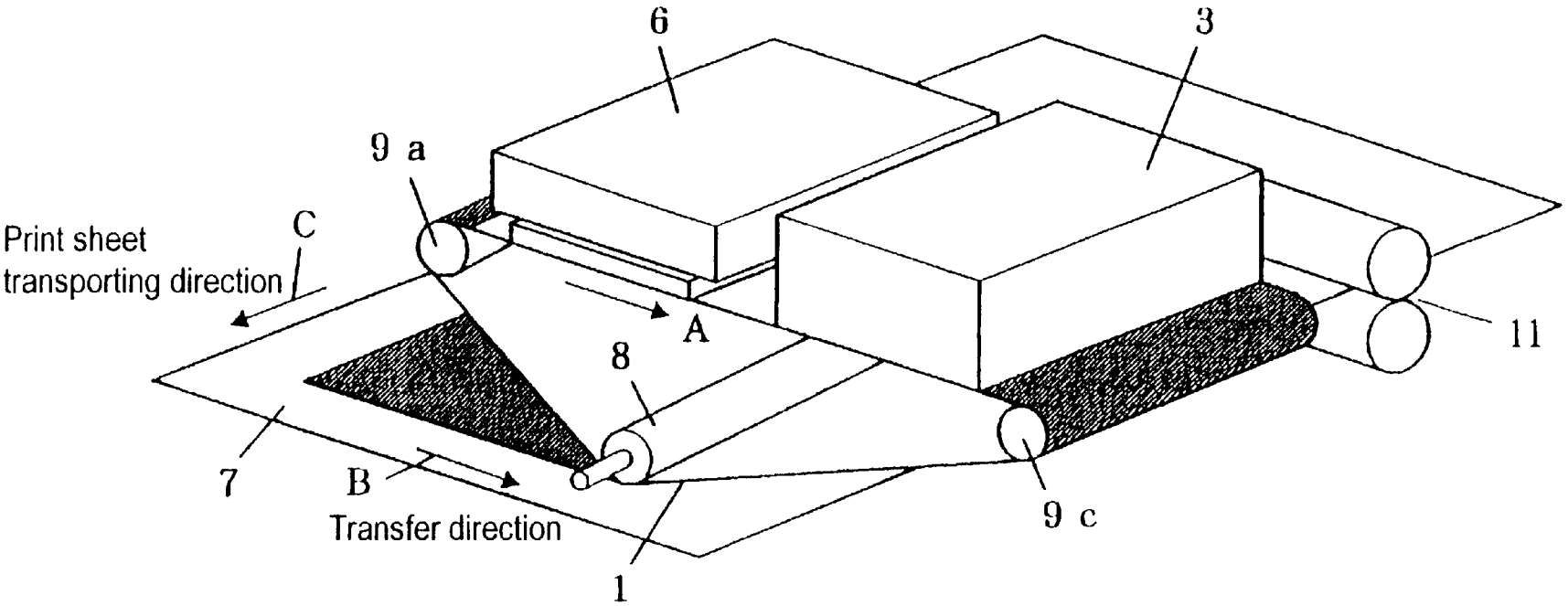
FIG. 10 PRIOR ART

FIG. 10 is a perspective view of the prior art image forming device of quadrature transfer system.

Figure 11:
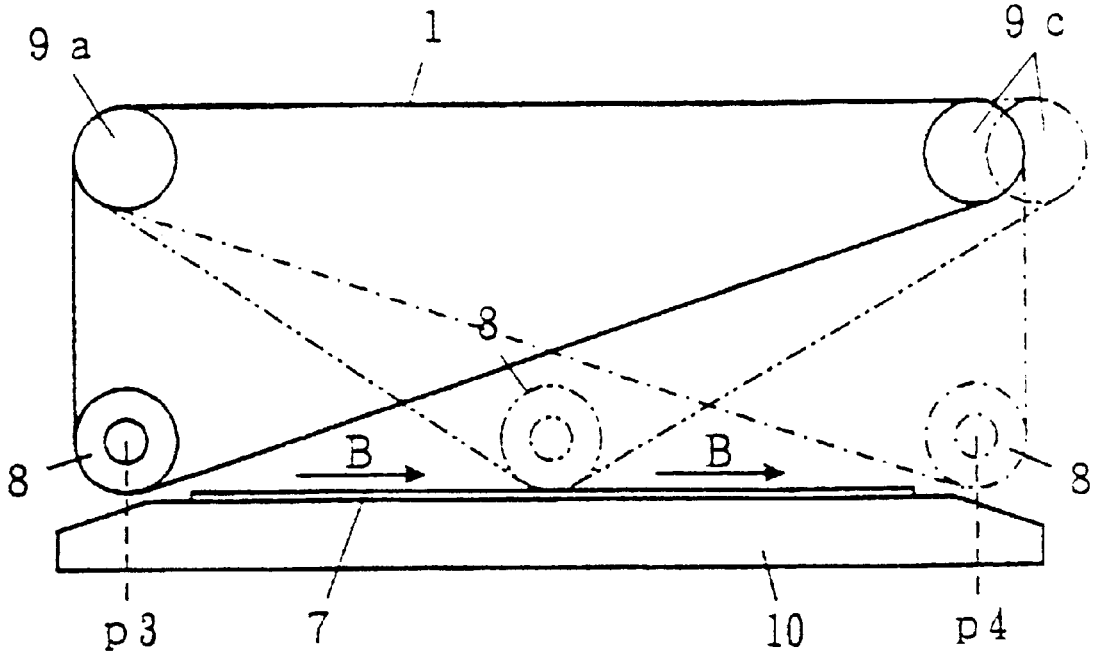
FIG. 11 PRIOR ART

FIG. 11 is a diagram to show a state of movement of an opposed transfer roller in the prior art image forming device of quadrature transfer system.

Figure 12:
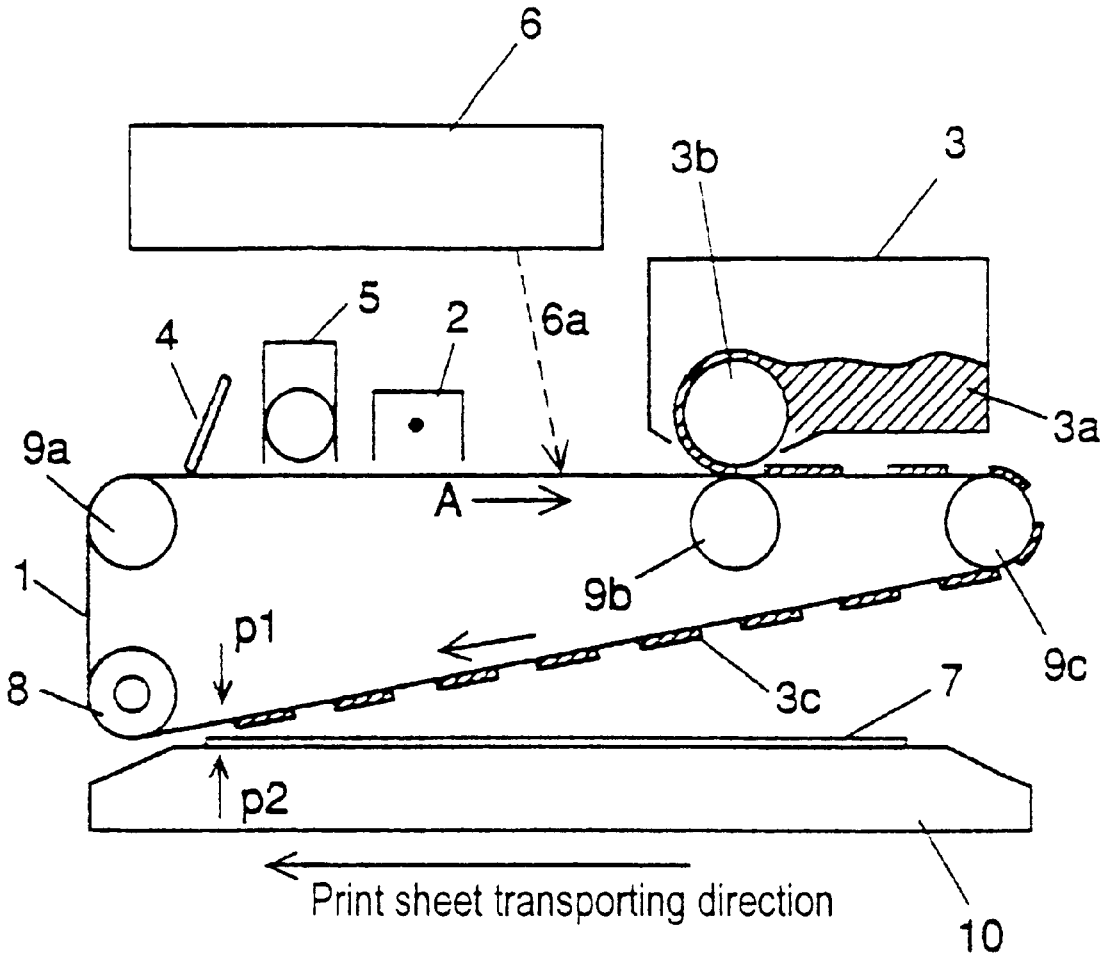
FIG. 12 PRIOR ART

FIG. 12 is a diagrammatic sketch of a prior art image forming device of parallel transfer system.

Figure 13:
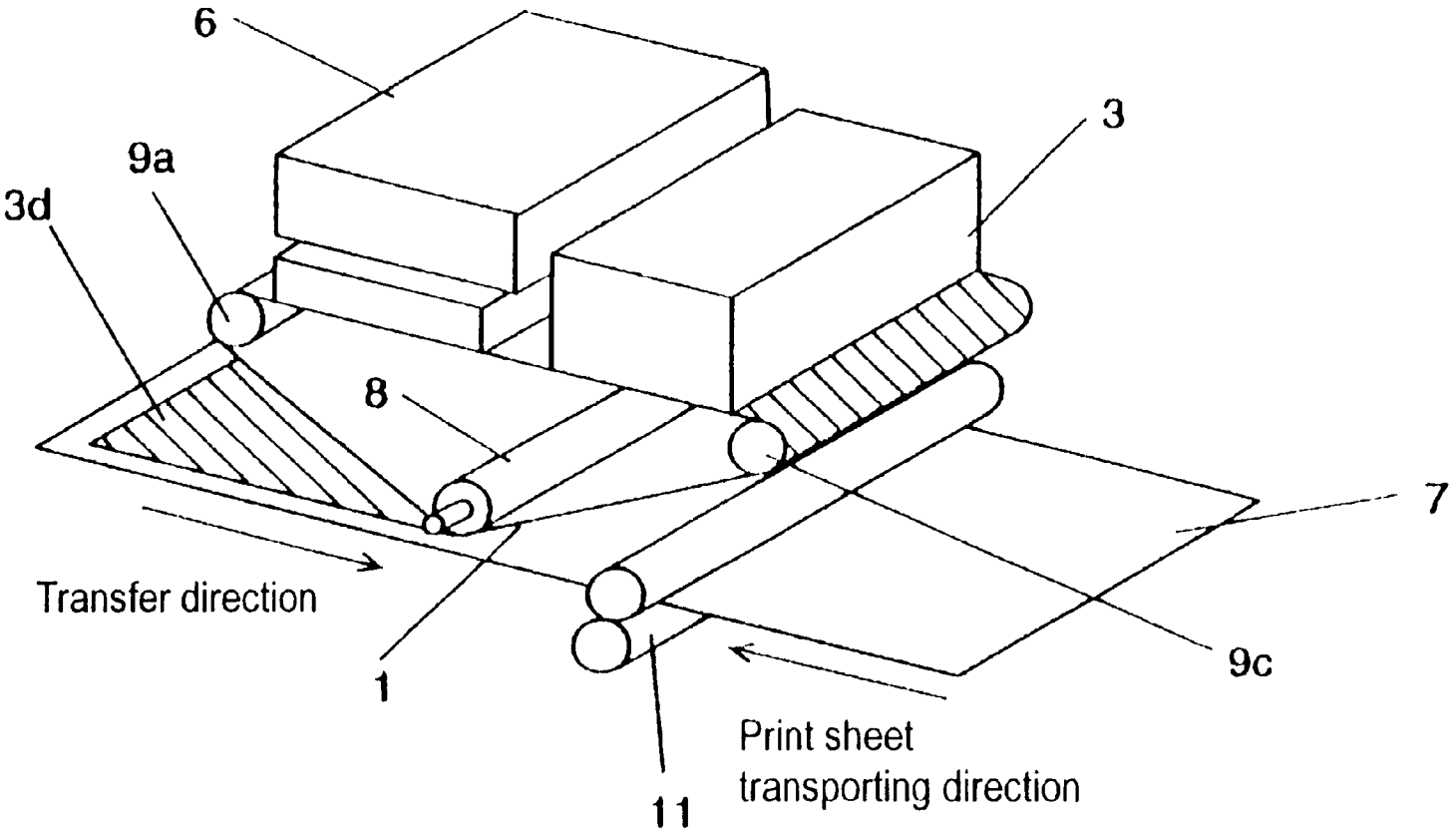
FIG. 13 PRIOR ART

FIG. 13 is a perspective view of the image forming device of FIG. 12.

Figure 14:
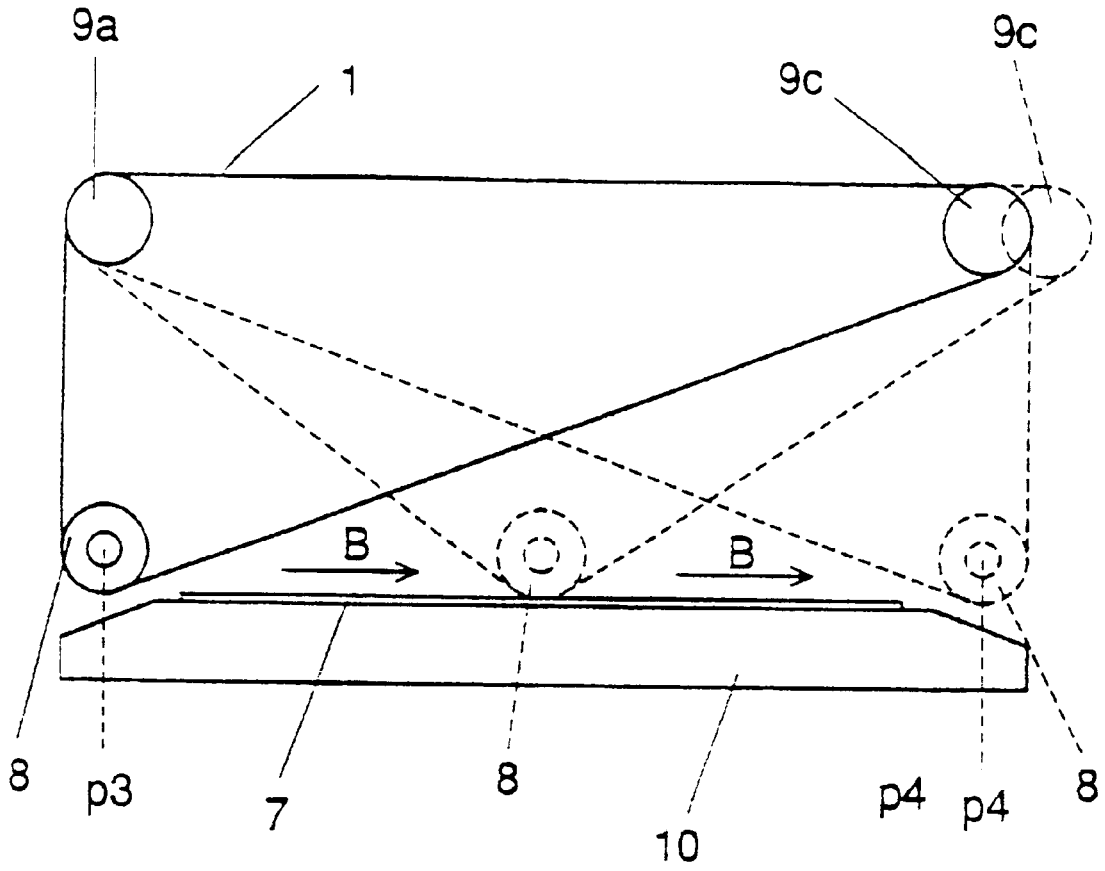
FIG. 14 PRIOR ART

FIG. 14 is a diagram to show a state of movement of the opposed transfer roller in the image forming device of FIG. 12.

PREFERRED EXEMPLARY EMBODIMENTS OF THE INVENTION

Preferred exemplary embodiments of the present invention will be explained below.

First Exemplary Embodiment

Figure 1:
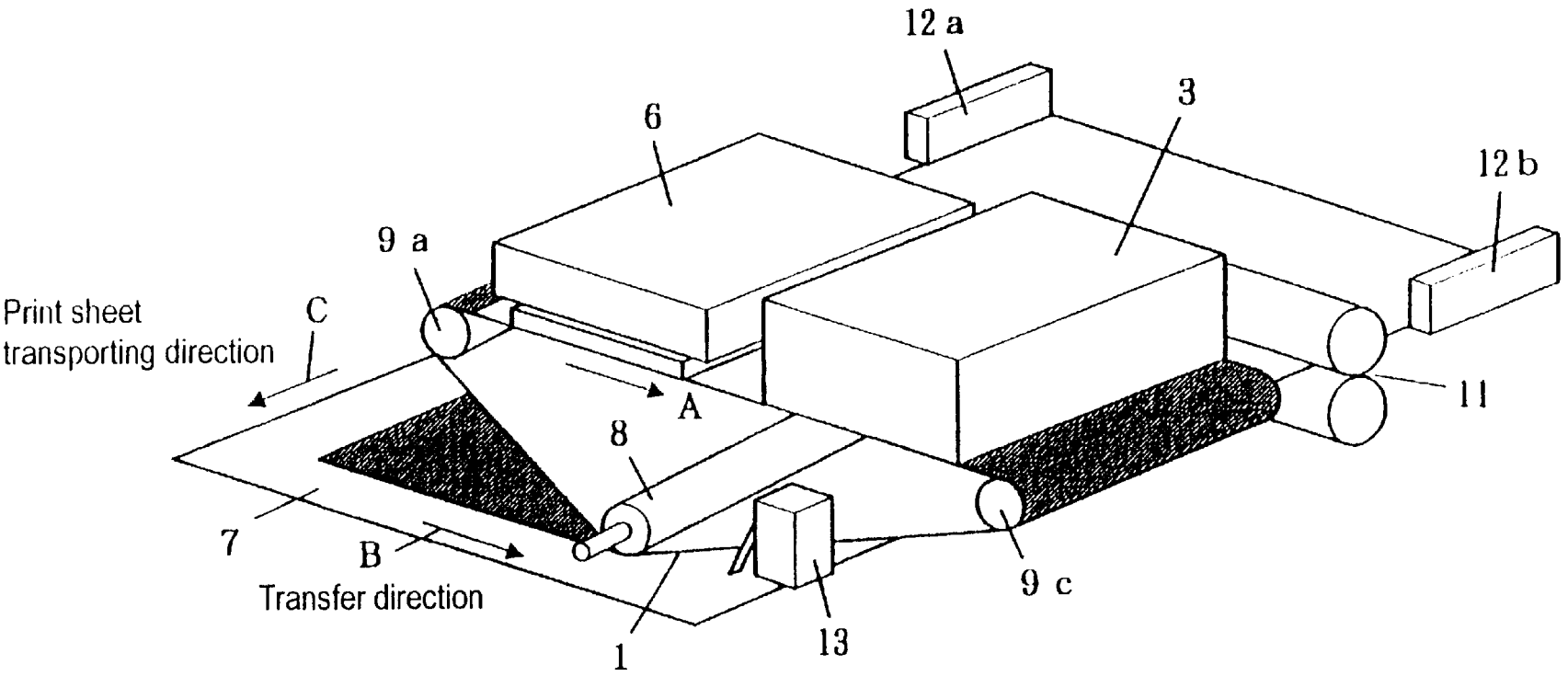
FIG. 1 is a perspective view of an image forming device of quadrature transfer system in a first exemplary embodiment of the present invention.
Figure 2:
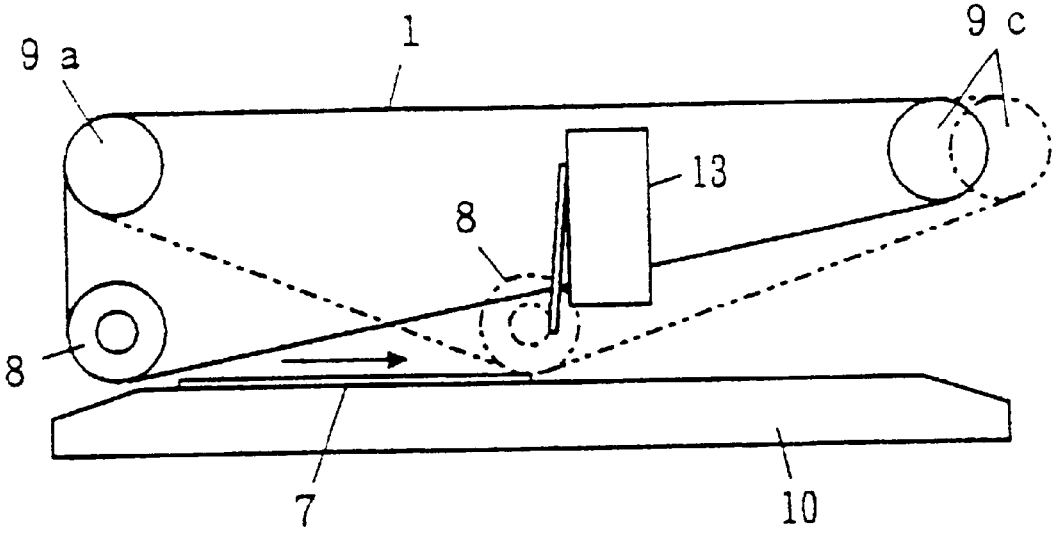
FIG. 2 is a diagram to show a state of movement of an opposed transfer roller when a print sheet is small in width in the image forming device of quadrature transfer system in the first exemplary embodiment of the present invention.
Figure 3:
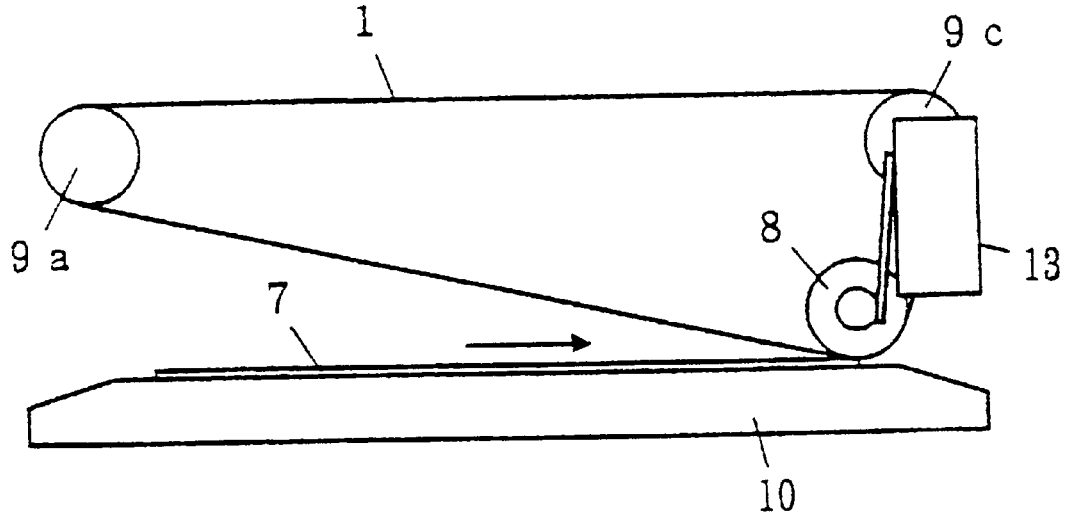
FIG. 3 is a diagram to show a state of movement of the opposed transfer roller when the print sheet is large in width in the image forming device of quadrature transfer system in the first exemplary embodiment of the present invention.
Figure 4A:
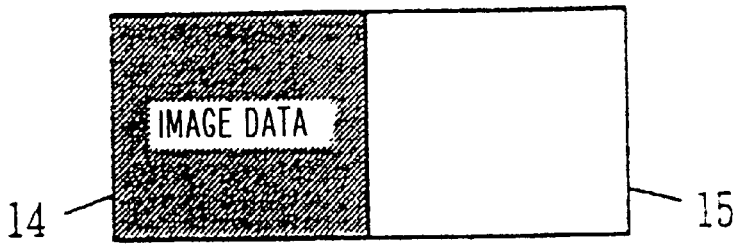
Figure 4B:
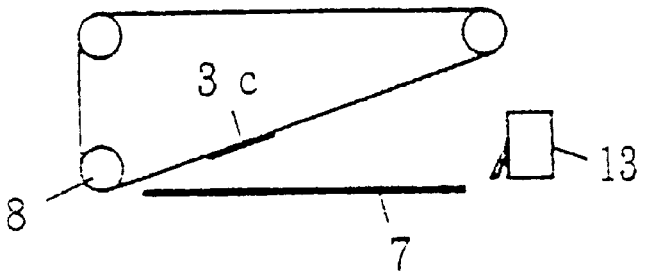
Figure 4C:
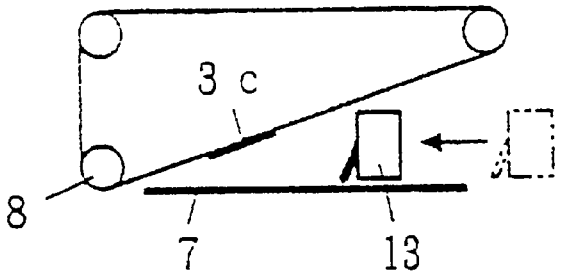
Figure 4D:
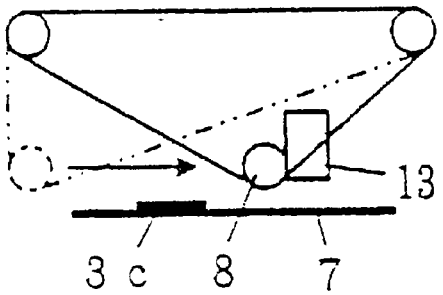
Figure 4E:
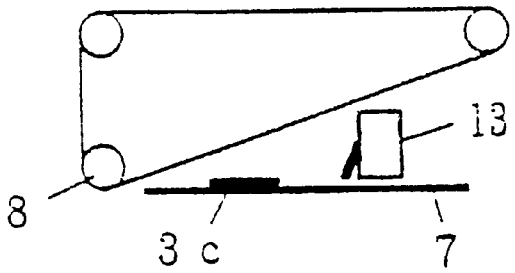

FIG. 1 is a perspective view of an image forming device of quadrature transfer system in a first exemplary embodiment of the present invention, FIG. 2 is a diagram to show a state of movement of an opposed transfer roller when a print sheet is small in width and FIG. 3 is a diagram to show a state of movement of the opposed transfer roller when the print sheet is large in width. In FIG. 1 to FIG. 3, the reference symbol 1 is a photosensitive belt, the reference symbol 3 is an image developer, the reference symbol 6 is a light exposure unit, the reference symbol 7 is a print sheet, the reference symbol 8 is an opposed transfer roller, the reference symbols 9*a* to 9*c* are photosensitive rollers, the reference symbol 10 is a transfer plate and the reference symbol 11 is a print sheet transporting roller.

As shown in FIG. 1 to FIG. 3, a closed loop belt like shape photosensitive belt 1, the surface of which is coated with an organic photoconductive material, is supported by photosensitive rollers 9*a* to 9*c* and an opposed transfer roller 8 and also made movable rotationally in the direction of an arrow A. A light exposure unit 6 and an image developer 3 are arranged in this order along the direction of rotational movement of the photosensitive belt 1. In addition, a print sheet 7 is supported by a transfer plate 10 and transported in the direction C perpendicular to the rotational direction A of the photosensitive belt 1 by a print sheet transporting roller 11 as shown in FIG. 1.

The reference symbols 12*a* and 12*b* are print sheet feeding guides and the reference symbol 13 is an opposed transfer roller detector for detecting the opposed transfer roller 8 in order to have the direction of the forward moving opposed transfer roller 8 (the direction indicated by an arrow B) reversed, namely making a U-turn from forward to backward.

An explanation will be made on how the image forming device as structured above operates.

Upon receiving directions for an image forming operation from a controller of the image forming device such as a CPU and the like, a photosensitive roller driving means such as a motor and the like makes the photosensitive rollers 9*a* to 9*c* rotate, thereby starting a rotational movement of the photosensitive belt 1 in the direction of an arrow A. First, the photosensitive belt 1 has the surface thereof charged by means of the charging unit 2 and then an electrostatic latent image is formed on the charged surface by laser light 6*a* irradiated from the light exposure unit 6 according to the content of the image to be formed.

When the area of the photosensitive belt 1, where the electrostatic latent image has been formed, arrives at the position of the image developer 3, the electrostatic latent image is developed by toner and a toner image is formed on the photosensitive belt 1.

After the toner image corresponding to a single sheet of the print sheet in size has been formed on the photosensitive belt 1 in the foregoing step of operation, the toner image is transferred from the photosensitive belt 1 onto the print sheet 7. At this time, the print sheet feeding guide 12*a* is fixed while one side of the print sheet 7 is always to be kept in touch with the print sheet feeding guide 12*a*. Thereafter, the print sheet feeding guide 12*b* can be changed in position to match the size of the print sheet 7. This print sheet feeding guide 12*b* is interlocked with the opposed transfer roller detector 13, which is moved from side to side in synchronization with the movement of the print sheet feeding guide 12*b* along a guide formed of a shaft and the like. When the opposed transfer roller detector 13 detects the opposed transfer roller 8 that is moving in the direction of the arrow B (forward moving direction), the opposed transfer roller 8 moves in the direction opposite (backward direction) to the direction of the arrow B (forward direction) and returns back to the original waiting position. When the width of a print sheet 7 is small, the opposed transfer roller detector 13 moves toward the inside as shown in FIG. 2 and the opposed transfer roller 8 starts turning back at the position shown in FIG. 2. When the width of a print sheet 7 is large, the opposed transfer roller detector 13 remains staying at the end position and the opposed transfer roller 8 turns back after having shifted to the largest extent as shown in FIG. 3.

Upon completion of the transfer of the toner image, the print sheet transporting roller 11 is rotated in the reversed direction and the print sheet 7, on which an image is formed, is rolled out. When the rolling out of the print sheet 7 is finished, the photosensitive belt 1 starts to rotate again, the area, where the toner image 3*c* was transferred on the photosensitive belt 1, gets rid of the toner that remained on the photosensitive belt 1 by means of a photosensitive belt cleaner and then the electric charge that remained on the photosensitive belt 1 is made to disappear by means of a discharging unit.

Accordingly, a given image such as lettering, graphics and the like is formed on a single sheet of the print sheet 7, and the same image forming process as above is repeated in succession as needed.

As described in the foregoing first exemplary embodiment, shifting of the opposed transfer roller 8 in position is made possible in accordance with the size of the print sheet 7 and transferring of a toner image on a transfer plate 10 by the movement of the opposed transfer roller 8 beyond the area occupied by the print sheet 7 can be prevented from taking place, thereby eliminating the problem of a back smear associated with a print sheet.

Second Exemplary Embodiment

An image forming device of quadrature transform system in a second exemplary embodiment of the present invention differs from the one in the first exemplary embodiment in the way that a controller, whereby an opposed transform roller detector 13 is moved from side to side, operates.

An explanation will be made on the operation of the image forming device in the second exemplary embodiment of the present invention with reference to FIG. 4(*a*) to FIG. 4(*e*), which illustrate how the image forming device in the present exemplary embodiment operates. An area for image data is shown in FIG. 4(*a*), a toner image that corresponds to the area for image data of FIG. 4(*a*) is shown in FIG. 4(*b*), an opposed transfer roller detector, the position of which is determined in accordance with the toner image of FIG. 4(*b*), is shown in FIG. 4(*c*) and a state of movement of an opposed transfer roller 8 is shown in each of FIG. 4(*d*) and FIG. 4(*e*). In FIG. 4(*a*) to FIG. 4(*e*), the toner image 3*c*, print sheet 7, opposed transfer roller 8 and opposed transfer roller detector 13 are the same as indicated in FIG. 1 to FIG. 3, and therefore the same reference symbols are assigned thereto as used in FIG. 1 to FIG. 3 with a specific description of each item omitted. The reference symbol 14 shows the area for image data in an image data storing memory 15.

As indicated in the toner image 3*c* of FIG. 4(*b*), the size (width) of an image formed on a photosensitive belt 1 is determined by an image data amount detector 14 contained in the image data storing memory 15. A controller (not shown in the drawings) calculates the size of the image and make the opposed transfer roller detector 13 move so as to have the opposed transfer roller 8 shifted in position by the amount corresponding to the size of the image, (FIG. 4(*c*)). Then, only the area where the toner image 3*c* exists is transferred when transferring is performed by having the opposed transfer roller 8 moved, (FIG. 4(*d*)), and the opposed transfer roller 8 is moved in a reversed direction (backward direction), returning back to the original waiting position as shown in FIG. 4(*e*).

Although an opposed transfer roller detector 13 was used in the first and second exemplary embodiments of the present invention for detecting the position of an opposed transfer roller 8, the detection might be carried out by utilizing the count of pulses generated in accordance with the amount of rotation of the opposed transfer roller 8.

According to the foregoing second exemplary embodiment, the opposed transfer roller 8 is made to move in the forward direction by an amount equal to the size (width) of an image and to start returning in the backward direction at the moment when the opposed transfer roller 8 has traveled the distance equal to the size of the image, thereby enabling the shifting of the opposed transfer roller 8 over the distance matching the size of the image to be printed and the reduction in a period of time required for image transferring when the image to be printed is small.

Third Exemplary Embodiment

FIG. 5 is a cross-sectional view of an image forming device of parallel transfer system in a third exemplary embodiment of the present invention to show a state of movement of an opposed transfer roller when the amount of image data is small, FIG. 6 is a cross-sectional view of the image forming device of parallel transfer system of FIG. 5 to show a state of movement of the opposed transfer roller when the amount of image data is large and FIG. 7 is a control block diagram of the image forming device of parallel transfer system in the third exemplary embodiment of the present invention.

The same components constituting the image forming device of the present exemplary embodiment as used in the first and second exemplary embodiments are referred to by common reference symbols and the detailed descriptions thereof are omitted.

In FIG. 5 and FIG. 6, the component of the reference symbol 20 is an opposed transfer roller detector which is movable by traversing in parallel with the shifting direction of an opposed transfer roller 8. This opposed transfer roller detector 20 has an opposed transfer roller detector driving motor 17 built in so as to run freely horizontally by self-propelling at a position a little apart from the edge of a photosensitive belt 1, the edge being situated in the direction of the width of the photosensitive belt 1. The output shaft of the opposed transfer roller detector driving motor 17 is kept in contact with a guide rail (not shown in the drawings), for example, that is positioned in parallel with the upper surface of a transfer plate 10, thus allowing the opposed transfer roller detector 20 to traverse according to the rotational direction of the foregoing output shaft.

A contacting member 20*a* to hit a protruding shaft 8*a* projected from the end of the opposed transfer roller 8 is provided on the opposed transfer roller detector 20, thereby making it possible to provide a signal, which is produced by the contacting member 20*a* at the time of hitting the protruding shaft 8*a*, to the input of a controller.

In the control block diagram of FIG. 7, the reference symbol 18 is an image data storing memory, the reference symbol 14 is an image data amount detector to obtain the size of an image formed on the photosensitive belt 1 by calculation based on the size of the image data stored in the image data storing memory 18, the reference symbol 19 is an opposed transfer roller detector position calculating unit to calculate the amount of rotation for the opposed transfer roller detector driving motor 17 to have the opposed transfer roller 8 moved in accordance with the size of image obtained by calculation in the image data amount detector 14, and the reference symbol 16 is a motor controller to move the opposed transfer roller detector 20 of the opposed transfer roller 8 by driving the opposed transfer roller detector driving motor 17 by an amount of rotation obtained by calculation in the opposed transfer roller detector position calculating unit 19.

FIG. 8 shows diagrams describing the performance of the image forming device of parallel transfer system in the present exemplary embodiment when the stroke, or the width of shifting, of the opposed transfer roller is changed according to the amount of image data.

To begin with, when an image is formed only on the diagonally shaded area located in the left half of a print sheet 7 as shown in FIG. 8(*a*), the position of a toner image 3*c* to be formed on the photosensitive belt 1 is determined so as to correspond to the foregoing area and when the area of the photosensitive belt 1, where the toner image 3*c* is transported, arrives at the position opposing to the print sheet 7 as shown in FIG. 8(*b*), the photosensitive belt 1 comes to a stop.

On the other hand, since the toner image 3*c* to be printed was already stored in the image data storing memory 18 at the time of gaining the corresponding input print signal, the size of the image to be formed on the photosensitive belt 1 is calculated by feeding the image data relative to the foregoing toner image 3*c* into the image data amount detector 14. The result of this calculation is fed into the opposed transfer roller detector position calculating unit 19 to have the amount of shifting of the opposed transfer roller detector 20 calculated in order for the opposed transfer roller detector 20 to move to the position where the opposed transfer roller 8 comes to a stop after traveling the distance to cover the size of a developed image. According to the result of this calculation, the rotational amount of the output shaft of the opposed transfer roller detector driving motor 17 is obtained by calculation in order for the opposed transfer roller detector 20 to travel a given distance and the motor controller 16 controls the opposed transfer roller detector driving motor 17 accordingly.

By controlling the amount of shifting of the opposed transfer roller detector driving motor 17 as described in the above, the opposed transfer roller detector driving motor 17 is moved to the position as indicated in FIG. 8(*c*). Then, the opposed transfer roller 8 is driven to move toward right side as indicated in FIG. 8(*d*), thereby having only the area, where the toner image 3*c* has been formed, transferred onto the print sheet 7 to have an image 3*d* formed thereon. On the other hand, the opposed transfer roller detector 20 travels a sufficient distance for the opposed transfer roller 8 to form the image 3*d*, and gets to and stays at the position, where the contacting member 20*a* thereof hits the protruding shaft 8*a* of the opposed transfer roller 8. Therefore, when the protruding shaft 8*a* comes into contact with the contacting member 20*a*, the opposed transfer roller 8 stops for a moment and moves in the reversed direction to return to the original waiting position as shown in FIG. 8(*e*).

As described in the above, with the image forming device in the third exemplary embodiment of the present invention, controlling the extent of stroke of the opposed transfer roller 8 in accordance with the size of the image to be printed is possible. Therefore, when an image to be printed is small as shown in FIG. 5, the opposed transfer roller detector 20 is moved to almost the middle position of the transfer plate 10 and the opposed transfer roller 8 is stopped halfway and then returned to the original position. Accordingly, the opposed transfer roller 8 traverses back to the original position after having traveled the distance needed to cover the image to be printed and, when compared with the case where the opposed transfer roller 8 is moved to the right end of the transfer plate 10 and then returned to the original position, the time period for shifting required of the opposed transfer roller 8 is cut to almost one half.

One half of the print sheet 7 in area is made a printing area in the example of FIG. 5, but in case where the print sheet is a post card, the size of which is about one half of the size of the print sheet of FIG. 5, this post card can be placed in the area of the left half of the transfer plate 10 for the same steps of operation as above.

When an image is printed on the almost entire surface of the print sheet 7 as shown in FIG. 6, the opposed transfer roller 8 is moved to the same position as conventionally performed.

In this case, it is not necessary for the contacting member 20*a* of the opposed transfer roller detector 20 made to hit the protruding shaft 8*a* without fail in terms of positioning, and the opposed transfer roller 8 is allowed only to move back and forth reciprocally within the extent of the maximum traverse thereof.

Although the returning of the opposed transfer roller 8 is performed by means of the opposed transfer roller detector 20 utilizing a mechanical contact in the above example, controlling of the returning might be performed equally well by obtaining by calculation the required amount of rotation for the driving motor of the opposed transfer roller 8 from the amount of image data, instead.

INDUSTRIAL APPLICABILITY

According to the image forming device of the present invention as described in the above, the direction, in which an opposed transfer roller is moving, can be reversed when the opposed transfer roller arrives at a specified position while the position thereof being detected, thereby allowing the opposed transfer roller to travel a distance that corresponds to the size (width) of a print sheet and preventing the transferring of a toner image onto a transfer plate that is caused by the opposed transfer roller moving beyond the distance equal to the width of the print sheet to attain such excellent effects as the prevention of a back smear applied to the print sheet and the realization of a shorter transfer time.

The image forming device is also provided with a print sheet feeder that detects the size of print sheets and a controller can determine the moving distance of the opposed transfer roller according to the size of the print sheet detected in the print sheet feeder, thereby enabling the control of the distance traveled by the opposed transfer roller in accordance with the size (width) of the print sheet and the prevention of transferring the toner image beyond the width of the print sheet to attain such an excellent effect as the prevention of a back smear applied to the print sheet is made possible.

Further, the image forming device is provided with an image processing unit that detects the width of developed image data and a controller can determine the moving distance of the opposed transfer roller according to the width of the image data detected in the image processing unit, thereby enabling the control of the distance traveled by the opposed transfer roller in accordance with the width of the image data to attain such an excellent effect as the realization of a shorter transfer time determined in accordance with the image data.

What is claimed is:

1. An image forming device comprising:

an image carrying belt of a closed loop belt like shape to carry a toner image;

an opposed transfer roller arranged on the inner side of said image carrying belt to transfer the toner image as carried on said image carrying belt onto a record medium by moving along the record medium;

a detecting means for detecting the position of said opposed transfer roller;

a controlling means for reversing the moving direction of said opposed transfer roller when the position of said opposed transfer roller detected by said detecting means reaches a specified position; and a width detecting means for detecting the width of a print medium in the moving direction of said opposed transfer roller, and characterized by having the moving direction of said opposed transfer roller reversed when the position of said opposed transfer roller detected by said detecting means reaches the position corresponding to the width of the print medium detected by said width detecting means, said width detecting means including a print sheet feeding guide, said detecting means being interlocked with said print sheet feeding guide such that the width of the print sheet feeding guide determines the position at which said detecting means will cause said opposed transfer roller to reverse direction.

2. An image forming device comprising:

an image carrying belt of a closed loop belt like shape to carry a toner image;

an opposed transfer roller arranged on the inner side of said image carrying belt to transfer the toner image as carried on said image carrying belt onto a record medium by moving along the record medium;

a detecting means for detecting the position of said opposed transfer roller;

a controlling means for reversing the moving direction of said opposed transfer roller when the position of said opposed transfer roller detected by said detecting means reaches a specified position; and a width detecting means for detecting the width of image information in the moving direction of said opposed transfer roller, and characterized by having the moving direction of said opposed transfer roller reversed when the position of said opposed transfer roller detected by said detecting means reaches the position corresponding to the width of the image information detected by said width detecting means.

3. An image forming device comprising:

an image carrying belt of a closed loop belt like shape to carry a toner image;

an opposed transfer roller arranged on the inner side of said image carrying belt to transfer the toner image as carried on said image carrying belt onto a record medium by moving along the record medium; and a controlling means for changing the moving width of said opposed transfer roller, said controlling means changing the moving width on the basis of the width of image information to be printed on said record medium.

4. The image forming device according to claim 3, further comprising:

a width detecting means for detecting the width of said image information in the moving direction of said opposed transfer roller;

said controlling means operative for changing the moving width of said opposed transfer roller in accordance with the width of the image information detected by said width detecting means.

5. The image forming device according to claim 3, characterized by being an image forming device of quadrature transfer system provided with:

said image carrying belt of a closed loop belt like shape to carry the toner image made movable in the direction perpendicular to a direction, in which the record medium is transported; and said opposed transfer roller, which is arranged on the inner side of said image carrying belt, made movable in the direction perpendicular to the direction, in which the record medium is transported, thereby transferring the toner image as carried on said image carrying belt onto the record medium with said image carrying belt pressed against the record medium by means of said opposed transfer roller, and further comprising:

a width detecting means for detecting the width of a print medium in the moving direction of said opposed transfer roller.

6. The image forming device according to claim 3, characterized by being an image forming device of quadrature transfer system provided with:

said image carrying belt of a closed loop belt like shape to carry the toner image according to image information made movable in the direction perpendicular to a direction, in which the record medium is transported; and said opposed transfer roller, which is arranged on the inner side of said image carrying belt, made movable in the direction perpendicular to the direction, in which the record medium is transported, thereby transferring the toner image as carried on said image carrying belt onto the record medium with said image carrying belt pressed against the record medium by means of said opposed transfer roller, and further comprising:

a width detecting means for detecting the width of the image information in the moving direction of said opposed transfer roller.

7. The image forming device according to claim 3, characterized by being an image forming device of parallel transfer system provided with:

said image carrying belt of a closed loop belt like shape to carry the toner image made movable in the direction parallel to a direction, in which the record medium is transported; and said opposed transfer roller, which is arranged on the inner side of said image carrying belt, made movable in the direction parallel to the direction, in which the record medium is transported, thereby transferring the toner image as carried on said image carrying belt onto the record medium with said carrying belt pressed against the record medium by means of said opposed transfer roller, and further comprising:

a width detecting means for detecting the width of a print medium in the moving direction of said opposed transfer roller.

8. The image forming device according to claim 3, characterized by being an image forming device of parallel transfer system provided with:

said image carrying belt of a closed loop belt like shape to carry the toner image according to image information made movable in the direction parallel to a direction, in which the record medium is transported; and said opposed transfer roller, which is arranged on the inner side of said image carrying belt, made movable in the direction parallel to the direction, in which the record medium is transported, thereby transferring the toner image as carried on said image carrying belt onto the record medium with said carrying belt pressed against the record medium by means of said opposed transfer roller, and further comprising:

a width detecting means for detecting the width of the image information in the moving direction of said opposed transfer roller.

9. An image forming device of quadrature transfer system comprising:

an image carrying belt of a closed loop belt like shape to carry a toner image;

an opposed transfer roller arranged on the inner side of said image carrying belt to transfer the toner image as carried on the image carrying belt onto a record medium by moving along the record medium;

a detecting means for detecting the position of said opposed transfer roller; and a controlling means for reversing the moving direction of said opposed transfer roller when the position of said opposed transfer roller detected by said detecting means reaches a specified position, wherein the image carrying belt of a closed loop belt like shape to carry the toner image according to image information is made movable in the direction perpendicular to a direction, in which the record medium is transported, and also the opposed transfer roller arranged on the inner side of said image carrying belt is made movable in the direction perpendicular to the direction, in which the record medium is transported, thereby transferring the toner image as carried on said image carrying belt onto the record medium with said image carrying belt pressed against the record medium by means of said opposed transfer roller, and further having:

a width detecting means for detecting the width of the image information in the moving direction of said opposed transfer roller;

said moving width of said opposed transfer roller being controlled in accordance with the width of the image information detected by said width detecting means.

10. An image forming device of parallel transfer system comprising:

an image carrying belt of a closed loop belt like shape to carry a toner image;

an opposed transfer roller arranged on the inner side of said image carrying belt to transfer the toner image as carried on the image carrying belt onto a record medium by moving along the record medium;

a detecting means for detecting the position of said opposed transfer roller; and a controlling means for reversing the moving direction of said opposed transfer roller when the position of said opposed transfer roller detected by said detecting means reaches a specified position, wherein the image carrying belt of a closed loop belt like shape to carry the toner image according to image information is made movable in the direction parallel to a direction, in which the record medium is transported and also the opposed transfer roller arranged on the inner side of said image carrying belt is made movable in the direction parallel to the direction, in which the record medium is transported, thereby transferring the toner image as carried on said image carrying belt onto the record medium with said image carrying belt pressed against the record medium by means of said opposed transfer roller, and further having:

a width detecting means for detecting the width of the image information in the moving direction of said opposed transfer roller;

said moving width of said opposed transfer roller being controlled in accordance with the width of the image information detected by said width detecting means.

* * * * *